US010206028B2

(12) United States Patent
Kimura

(10) Patent No.: US 10,206,028 B2
(45) Date of Patent: Feb. 12, 2019

(54) DAMPER AND SPEAKER APPARATUS

(71) Applicants: Pioneer Corporation, Tokyo (JP); Tohoku Pioneer Corporation, Yamagata (JP)

(72) Inventor: Yoshihiro Kimura, Yamagata (JP)

(73) Assignees: PIONEER CORPORATION, Tokyo (JP); TOHOKU PIONEER CORPORATION, Yamagata (JP)

( * ) Notice: Subject to any disclaimer, the term of this patent is extended or adjusted under 35 U.S.C. 154(b) by 0 days.

(21) Appl. No.: 15/502,668

(22) PCT Filed: Aug. 22, 2014

(86) PCT No.: PCT/JP2014/072024

§ 371 (c)(1),
(2) Date: Feb. 8, 2017

(87) PCT Pub. No.: WO2016/027375

PCT Pub. Date: Feb. 25, 2016

(65) Prior Publication Data

US 2017/0238086 A1 Aug. 17, 2017

(51) Int. Cl.
*H04R 9/06* (2006.01)
*H04R 1/28* (2006.01)
(Continued)

(52) U.S. Cl.
CPC ..... *H04R 1/288* (2013.01); *H04R 9/02* (2013.01); *H04R 9/041* (2013.01); *H04R 9/043* (2013.01);
(Continued)

(58) Field of Classification Search
CPC ... H04R 7/16; H04R 7/18; H04R 7/20; H04R 9/041; H04R 9/043; H04R 9/045;
(Continued)

(56) References Cited

U.S. PATENT DOCUMENTS 6,351,544 B1 * 2/2002 Noll ..... H04R 7/20 381/398
6,567,528 B1 * 5/2003 Heed ..... H04R 9/043 181/166
8,094,862 B2 * 1/2012 Funahashi ..... H04R 9/043 381/398

FOREIGN PATENT DOCUMENTS

JP 65-85096 5/1987
JP 11-262088 9/1999
JP 2003-518856 6/2003

OTHER PUBLICATIONS

Japanese Official Action—2016-553783—dated Aug. 29, 2017.
International Search Report, PCT/JP2014/072024, dated Nov. 4, 2014.

* cited by examiner

*Primary Examiner* — Huyen D Le
(74) *Attorney, Agent, or Firm* — Young & Thompson

(57) ABSTRACT

A damper and a speaker apparatus includes the damper, which suppresses damage to an oscillatory system from an excessive input signal, enabling an efficiency increase of the speaker apparatus. As a damper has a planar surface, undue deformation of the oscillatory system due to an excessive input signal is suppressed, and damage to the oscillatory system can be suppressed. Furthermore, since the deformation of a corrugation portion by a normal input signal is hardly prevented, a reduction in sound pressure of the speaker apparatus with respect to an input signal is suppressed, enabling an increase in efficiency. Furthermore, the planar surface is extended at a height in a thickness direction different from that of an attachment portion. Thus, rising portions are deformed when a voice coil bobbin is oscillated, enabling suppression of rupture of the damper in the vicinity
(Continued)

of a boundary between the planar surface and the attachment portion.

10 Claims, 5 Drawing Sheets

(51) Int. Cl.
*H04R 9/04* (2006.01)
*H04R 9/02* (2006.01)

(52) U.S. Cl.
CPC ..... *H04R 9/045* (2013.01); *H04R 9/06* (2013.01); *H04R 2231/003* (2013.01); *H04R 2307/207* (2013.01)

(58) Field of Classification Search
CPC ..... H04R 9/06; H04R 2231/001; H04R 2231/003; H04R 2307/201; H04R 2307/207; H04R 9/02
USPC ..... 381/396, 398, 403, 404, 405, 423, 432; 181/171, 172; 29/594, 609.1
See application file for complete search history.

DAMPER AND SPEAKER APPARATUS

TECHNICAL FIELD

The present invention relates to a damper and a speaker apparatus including the damper.

BACKGROUND ART

There has been proposed a speaker apparatus including a frame, a voice coil bobbin, a diaphragm connected to the voice coil bobbin, and a damper for fixing the diaphragm to the frame (see, for example, Patent Literature 1). The conventional speaker apparatus described in Patent Literature 1 includes restrictive protrusions for preventing excessive movement of the voice coil bobbin and prevents contact between the voice coil bobbin and other members.

CITATION LIST

Patent Literature

Patent Literature 1: JP 11-262088 A

SUMMARY OF INVENTION

Technical Problem

Incidentally, in general, a damper includes a corrugation portion which is concentrically formed to surround an opening and has a convexoconcave arranged in a radial direction in order to stabilize the direction of oscillation of the voice coil bobbin and to abate noise by suppressing unnecessary natural oscillations of oscillatory systems (diaphragm, damper, edge and the like). Regarding such a damper, an attachment portion (circumference of an opening portion) on the inner side of the corrugation portion is connected to the voice coil bobbin, and an attachment portion on the outer side is connected to the frame. With a speaker apparatus including such a damper, there is a possibility that, when an excessive input signal (e.g., signal by noise) is entered, the voice coil bobbin is driven to oscillate accordingly and the amplitude of the oscillatory systems following the voice coil bobbin is increased, resulting in damage.

Given the above, one conceivable configuration is that the damper is generally formed of a hard-to-deform material so that the amplitude of the oscillatory system as the voice coil bobbin is driven by an excessive input signal is suppressed. However, with such a damper, the amplitude of the oscillatory system is reduced even without an excessive input signal and the sound pressure of radiation sound with respect to the magnitude of the input signal is reduced, thereby reducing the efficiency of the speaker apparatus.

It is one exemplary object of the present invention to provide a damper and a speaker apparatus including the damper, the damper suppressing damage to an oscillatory system due to an excessive input signal and enables an increase in efficiency of the speaker apparatus.

Solution to Problem

In order to solve the problem and achieve the object, a damper of the present invention according to a first aspect of the present invention is characterized by including: an opening portion having one opening; a corrugation portion formed around the opening portion, the corrugation portion including at least one convexoconcave arranged in a radial direction; a planar portion formed around the corrugation portion, the planar portion having a planar surface; and an attachment portion formed around the planar portion, wherein the planar surface is extended substantially parallel to the attachment portion at a height in a thickness direction different from that of the attachment portion.

Meanwhile, the speaker apparatus of the present invention according to an eleventh aspect of the present invention is characterized by including the damper according to the first aspect.

DESCRIPTION OF EMBODIMENTS

Figure 1:
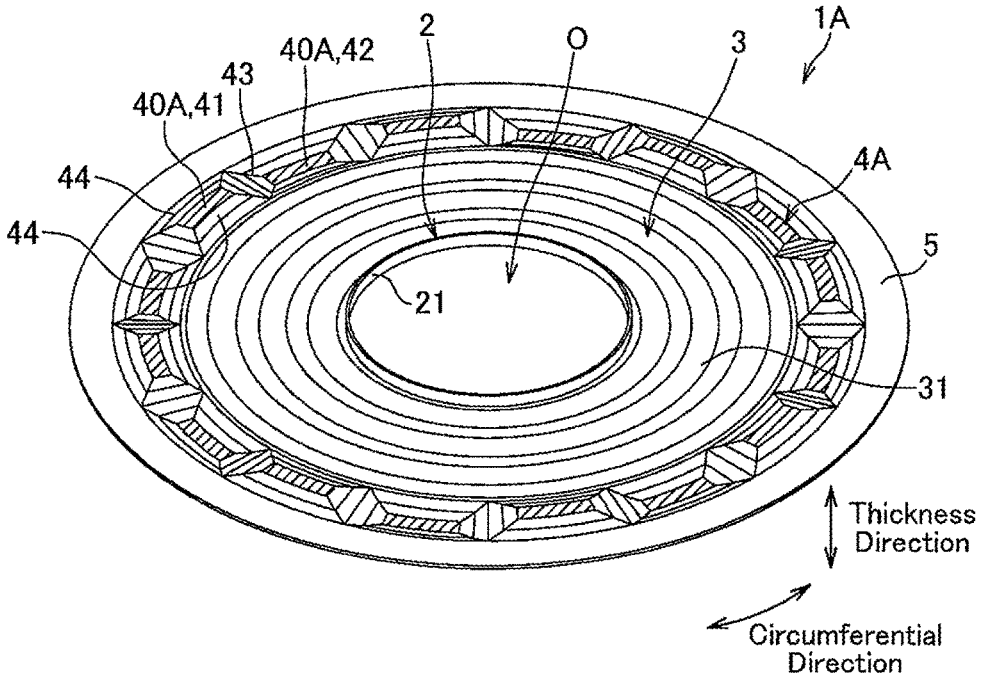
FIG. 1 is a perspective view illustrating a damper according to Example 1 of an embodiment of the present invention.

In the following, an embodiment of the present invention will be described. A damper according to the embodiment of the present invention includes an opening portion having one opening, a corrugation portion formed around the opening portion and including at least one convexoconcave arranged in a radial direction, a planar portion formed around the corrugation portion and having a planar surface, and an attachment portion formed around the planar portion, wherein the planar surface is extended substantially parallel to the attachment portion at a height in the thickness direction different from that of the attachment portion.

The planar portion of the damper has a planar surface. When a force in the thickness direction is applied to the damper, the planar portion is less deformable than the corrugation portion. Accordingly, when the voice coil bobbin is driven to oscillate in the thickness direction by an excessive input signal, the presence of the planar portion suppresses undue deformation of the damper as a whole, reducing the amplitude of the oscillatory system, thereby enabling suppression of damage to the oscillatory system. Furthermore, in the absence of an excessive input signal, the planar portion hardly prevents deformation of the corrugation portion in response to an input signal. Therefore, the sound pressure with respect to the magnitude of an input signal can be ensured.

Furthermore, the planar surface is extended at a height in the thickness direction different from that of the attachment portion. Thus, a portion extending in the thickness direction (rising portion) is formed between the planar surface and the attachment portion. When the voice coil bobbin is driven to oscillate in the thickness direction by an excessive input signal, the rising portion can be deformed and suppresses a stress from being concentrated on a boundary between the planar surface and the attachment portion to produce rupture of the damper in the vicinity of the boundary.

The planar portion preferably has the one planar surface. Thus, as described above, damage to the oscillatory system due to an excessive input signal is suppressed and the sound pressure with respect to the magnitude of an input signal can be ensured with the simple configuration.

The planar surface is preferably arranged on one side in the thickness direction beyond the attachment portion. In addition, the one side may be either the sound radiation side or the opposite side of the speaker apparatus.

The planar portion preferably has a plurality of the planar surfaces. Thus, the height in the thickness direction of each planar surface with respect to the attachment portion can be set properly, enabling adjustment of ease of deformation of the planar portion. In addition, the plurality of planar surfaces may be either arranged side by side along a radial direction or arranged side by side along a circumferential direction.

The plurality of planar surfaces preferably arranged side by side along a circumferential direction. Thus, a force applied to the damper by the voice coil bobbin is homogenized in a radial direction, enabling suppression of undue partial deformation of the damper.

The plurality of planar surfaces preferably includes a first planar surface and a second planar surface, which is arranged at a height in the thickness direction different from that of the first planar surface. The first planar surface and the second planar surface both may be arranged either on the sound radiation side or on the opposite side beyond the attachment portion, and one of the first planar surface and the second planar surface may be arranged on the sound radiation side and the other may be arranged on the opposite side. Such a configuration enables an increase in mechanical strength of the damper.

It is preferable that the first planar surface and the second planar surface are alternately arranged side by side in the circumferential direction. Thus, as described above, the ease of deformation of the planar portion can be adjusted easily.

The opening is formed in a circular shape in plan view. The plurality of planar surfaces preferably has rotational symmetry relative to an axis of symmetry, which is the axis that passes through the center of the opening and is parallel to the thickness direction. Thus, when the voice coil bobbin is oscillated in the thickness direction, the force applied to the damper from the voice coil bobbin is symmetric relative to the axis of symmetry. Thus, undue partial deformation of the damper is suppressed, and the acoustic characteristics of the speaker apparatus can be improved. In addition, it is sufficient that the plurality of planar surfaces have two- or more-fold rotational symmetry.

It is preferable to further include a connection for connecting the planar surfaces, which are adjacent to one another in the circumferential direction. Thus, the circumferentially adjacent planar surfaces are positioned and retained by the connection at different heights in the thickness direction.

It is preferable that the first planar surface is arranged on one side beyond the attachment portion in the thickness direction and the second planar surface is arranged on the other side beyond the attachment portion in the thickness direction. Thus, the deformability of the damper on the sound radiation side becomes equivalent to the deformability on the opposite side, enabling favorable preservation of the acoustic characteristics, e.g., distortion.

EXAMPLES

In the following, examples of the present invention will be described in detail. In Example 2, components similar to or having the same functions as components described in Example 1 are designated by the same reference numerals as those of Example 1, and the description is omitted.

Example 1

Figure 2:
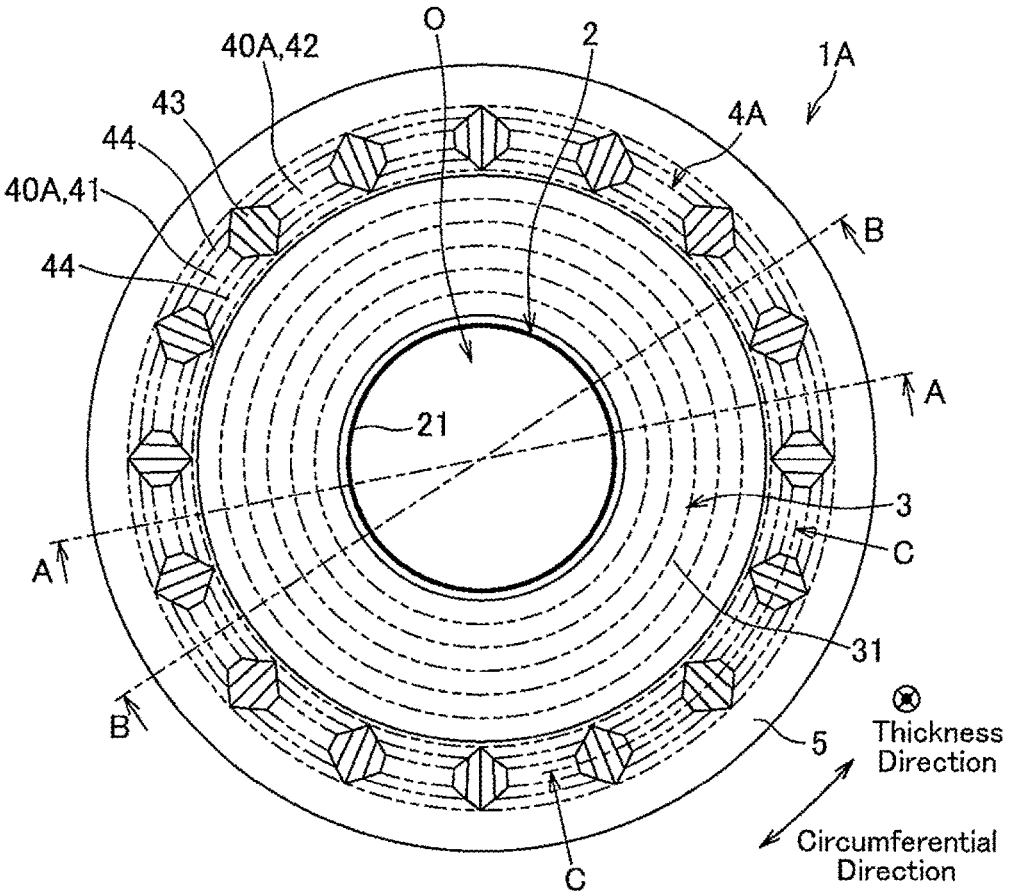
FIG. 2 is a plan view illustrating the damper.
Figure 3:
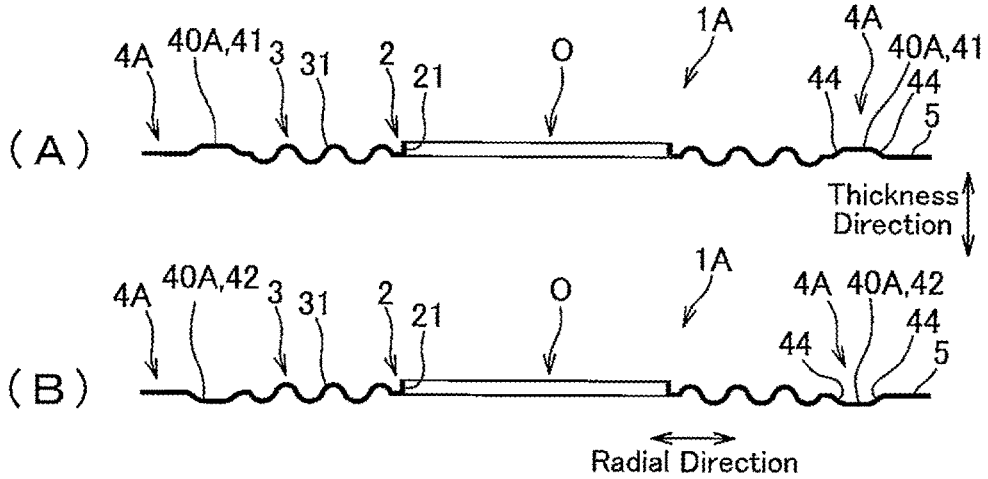
FIG. 3 is a cross-sectional view cut along line A-A and a cross-sectional view cut along line B-B of FIG. 2.
Figure 4:
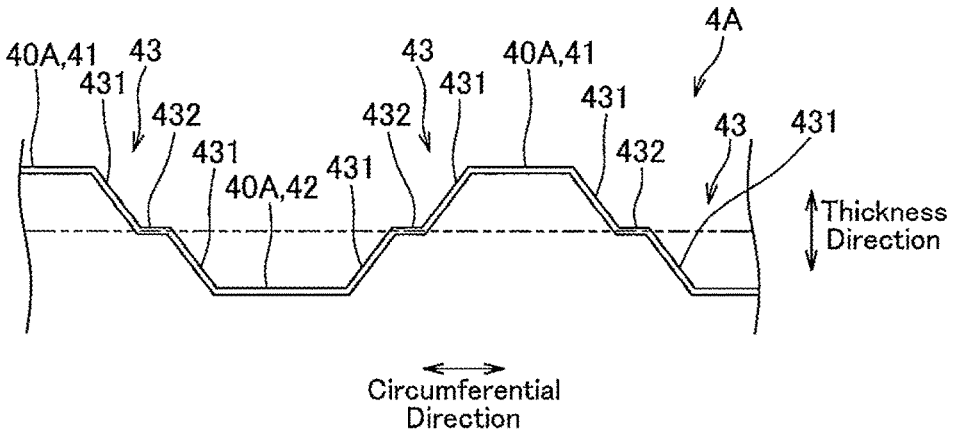
FIG. 4 is a cross-sectional view cut along line C-C of FIG. 2.
Figure 5:
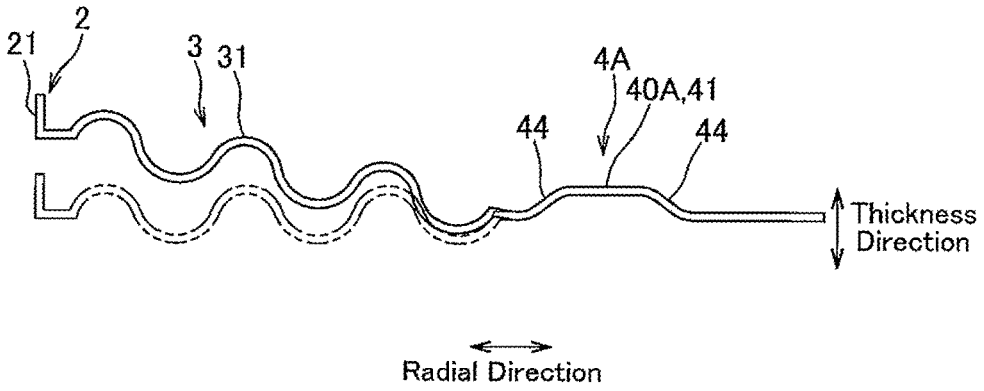
FIG. 5 is a cross-sectional view illustrating a state where the damper is deformed.

FIG. 1 is a schematic view illustrating a damper 1A according to Example 1 of the present invention. FIG. 2 is a plan view illustrating the damper 1A. FIGS. 3(A), 3(B) and 4 are cross-sectional views illustrating the damper 1A. FIG. 5 is a cross-sectional view illustrating a state where the damper 1A is deformed. In the present example, the thickness direction, the radial direction, and the circumferential direction are as indicated in FIGS. 1 to 4.

The damper 1A is generally formed in a plate shape and is formed of a fabric impregnated, for example, with phenol resin. The damper 1A includes an opening portion 2 having an opening O, a corrugation portion 3 formed around the opening portion 2, a planar portion 4A formed around the corrugation portion 3, and an attachment portion 5 formed around the planar portion 4A. The damper 1A is mounted on a speaker apparatus, which is not illustrated.

The opening portion 2 is formed around the opening O having a circular shape in plan view. An inner wall 21 having a cylindrical shape is configured to be attached to a voice coil bobbin of the speaker apparatus, which is not illustrated.

As illustrated in cross-section in FIGS. 3(A) and 3(B), the corrugation portion 3 is formed of a plurality (three for each in the present example) of corrugated convexoconcaves 31 arranged side by side in the radial direction. The corrugation portion 3 is formed in an annular shape surrounding the opening portion 2.

The planar portion 4A includes a plurality (16 in the present embodiment) of planar surfaces 40A extending substantially parallel to the attachment portion 5 at a height in the thickness direction different from that of the attachment portion 5, connections 43 for connecting the planar surfaces 40A to one another, and rising portions 44 arranged at two points across the planar surface 40A in the radial direction.

The plurality of planar surfaces 40A include eight first planar surfaces 41 arranged on one side (upper side) in the thickness direction beyond the attachment portion 5, as illustrated in FIG. 3(A) in cross-section, and eight second planar surfaces 42 arranged on the other side (lower side) in the thickness direction beyond the attachment portion 5, as illustrated in FIG. 3(B) in cross-section. The first planar surfaces 41 and the second planar surfaces 42 are alternately arranged side by side in the circumferential direction. Furthermore, the plurality of planar surfaces 40A have eight-fold rotational symmetry relative to an axis of symmetry, which is the axis that passes through the center of the opening O and is parallel to the thickness direction. Specifically, when the damper 1A is generally rotated about the axis of symmetry in multiples of 45 degrees, the plurality of planar surfaces 40A overlaps the pre-rotation shape.

The connection 43 is arranged between the first planar surface 41 and the second planar surface 42, which are adjacent to one another in the circumferential direction. As illustrated in FIG. 4, which is a cross-sectional view along the circumferential direction, the connection 43 includes a pair of inclination portions 431, which are inclined in the circumferential direction and are extended in the thickness direction, and an intermediate portion 432, which is arranged between the pair of inclination portions 431 and is extended in the circumferential direction. The connection 43 connects the first planar surface 41 and the second planar surface 42. The intermediate portion 432 is arranged at the substantially same height as the attachment portion 5 in the thickness direction (position indicated by the chain double-dashed line). The connection 43 may be extended in the thickness direction to connect the first planar surface 41 and the second planar surface 42 without circumferential inclination, and the intermediate portion 432 may be omitted.

The rising portions 44 are arranged between the planar surface 40A and the corrugation portion 3 and between the planar surface 40A and the attachment portion 5. As illustrated in FIG. 3(A), the rising portions 44 lying across the first planar surface 41 in the radial direction are radially inclined and extended upward from the corrugation portion 3 and the attachment portion 5. As illustrated in FIG. 3(B), the rising portions 44 lying across the second planar surface 42 in the radial direction are radially inclined and extended downward from the corrugation portion 3 and the attachment portion 5. Thus, as the rising portions 44 are arranged, the planar surface 40A is arranged on a plane at a height in the thickness direction different from that of the attachment portion 5. The rising portion 44 may have a shape extending along the thickness direction without inclination.

The attachment portion 5 is formed planar and is extended along the radial direction and the circumferential direction. A lower side surface as illustrated in FIG. 1 is attached to the frame of the speaker apparatus as an attachment surface. Specifically, the damper 1A is arranged on the speaker apparatus with an upper side surface facing the sound radiation side.

In the following, a state where the damper 1A is deformed is described with reference to FIG. 5. FIG. 5 illustrates a part of the damper 1A illustrated in cross-section in the same position as FIG. 3(A). The damper 1A is similarly deformed in the same position as FIG. 3(B) in the manner described below.

When the amplitude of the voice coil bobbin is small, as illustrated by the solid line in FIG. 5, the corrugation portion 3 of the damper 1A is stretched such that the height of the corrugated convexoconcave 31 is lowered and distance between the dent and the protrusion constituting the convexoconcave 31 is increased. Furthermore, the planar portion 4A of the damper 1A is deformed such that an angle made by the rising portion 44 and the planar surface 40A varies. The planar surface 40A is less deformable and deflectable than the corrugation portion 3.

When the amplitude of the voice coil bobbin is large, as the amount of stretch of the corrugation portion 3 is sufficiently large, the corrugation portion 3 hardly further deforms. The planar portion 4A is deformed such that an angle made by the planar surface 40A and the attachment portion 5 varies and an angle made by the rising portion 44 and the planar surface 40A varies. The planar surface 40A almost retains the original shape. Thus, as the corrugation portion 3 hardly deforms and the planar surface 40A hardly deforms, even when the voice coil bobbin is oscillated by an excessive input signal, undue general deformation of the damper 1A is suppressed, enabling a reduction in amplitude of the oscillatory system.

Regarding a conventional damper in which a corrugation portion is generally formed between the opening portion and the attachment portion without a planar portion, when a voice coil bobbin is oscillated by an excessive input signal, the damper is generally largely stretched. As a result, the amplitude of an oscillatory system can be excessively large, causing damage to the oscillatory system.

Furthermore, regarding such a conventional damper, in cases where the corrugation portion in the vicinity of the attachment portion is omitted and a planar surface extending in the same plane as the attachment portion (at the same height in the thickness direction) is formed in the above portion, when the voice coil bobbin is oscillated by an excessive input signal, undue deformation of the damper can be suppressed as with the damper 1A of Example 1. However, there is a possibility that a force is concentrated on a boundary between the planar surface and the attachment portion, resulting in rupture of the damper in the vicinity of the boundary.

With the aforementioned configuration, as the damper 1A includes the planar surface 40A, excessive deformation of the oscillatory system due to an excessive input signal is suppressed, enabling suppression of damage to the oscillatory system. Furthermore, the planar surface 40A hardly prevent deformation of the corrugation portion 3 due to a normal input signal. Therefore, the sound pressure with respect to the magnitude of an input signal can be ensured, enabling an increase in efficiency of the speaker apparatus.

Furthermore, as the planar surface 40A is extended at a height in the thickness direction different from that of the attachment portion 5, the rising portions 44 are deformed when the voice coil bobbin is oscillated, and rupture of the damper 1A in the vicinity of the boundary between the planar surface 40A and the attachment portion 5 can be suppressed.

Furthermore, as the first planar surface 41 is arranged on one side of the attachment portion 5 and the second planar surface 42 is arranged on the other side of the attachment portion 5, the deformability of the damper 1A on the sound radiation side becomes equivalent to the deformability on the opposite side, enabling favorable preservation of the acoustic characteristics, e.g., distortion.

Furthermore, as the plurality of planar surfaces 40A have rotational symmetry, when the voice coil bobbin is oscillated in the thickness direction, a force applied to the damper 1A from the voice coil bobbin becomes symmetric relative to the axis of symmetry, enabling suppression of undue partial deformation of the damper.

In the following, displacement with respect to an external force to the damper 1A of Example 1, a damper 100 of a conventional example, and a damper 200 of a comparative example is described on the basis of experimental results. Here, the damper 100 of the conventional example has an inside diameter (diameter of an opening portion) and an outside diameter, which are equal to those of the damper 1A of the present example, and includes a corrugation portion generally between the opening portion and an attachment portion. Furthermore, the damper 200 of the comparative example has the substantially same shape as the damper 100 of the conventional example and is formed of a material that is less deformable than that of the damper 100 of the conventional example.

Here, the material of the damper 1A is cotton, blended fabric or the like. The material of the dampers 100, 200 is chemical fiber or the like (the damper 200 of the comparative example is formed of chemical fiber the hardness of which is greater than that of the damper 100 of the conventional example). Both dampers 100, 200 are generally formed in a circular shape. The dimensions of each part are indicated in Table 1. The thickness indicates the thickness dimension of a damper at a planar part, e.g., the attachment portion. Each of dampers 1B, 100, 200 generally has a substantially uniform thickness.

TABLE 1

| | OUTSIDE DIAMETER OF ENTIRE DAMPER (mm) | DIAMETER OF OPENING (mm) | RADIAL DIMENSION OF CORRUGATION PORTION (mm) | RADIAL DIMENSION OF PLANAR PORTION (mm) | DIMENSION OF PLANAR PORTION IN THICKNESS DIRECTION (mm) | THICKNESS (mm) |
|---|---|---|---|---|---|---|
| EXAMPLE 1 | ϕ 92 | ϕ 31 | 16 | 8 | 1 | 0.3 |
| CONVENTIONAL EXAMPLE | ϕ 92 | ϕ 31 | 24 | — | — | 0.3 |
| COMPARATIVE EXAMPLE | ϕ 92 | ϕ 31 | 24 | — | — | 0.3 |

Figure 6:
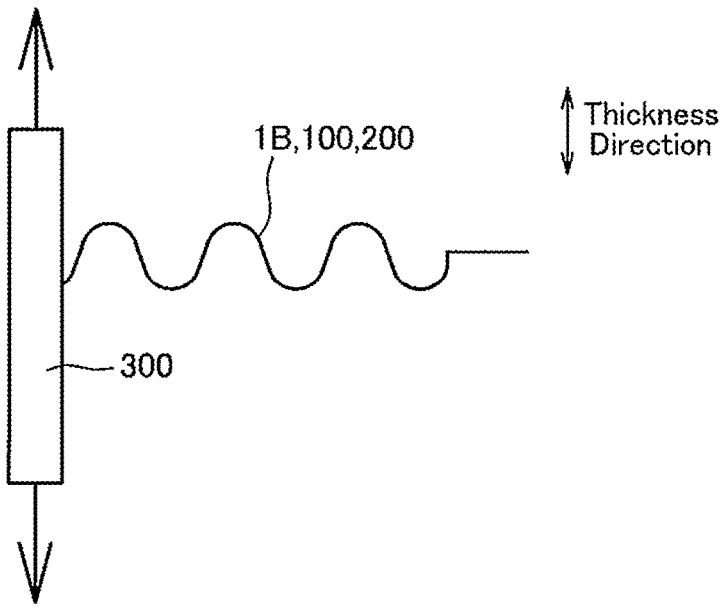
FIG. 6 is a schematic view illustrating a state where an external force is applied to the damper and the diaphragm and the displacement is measured.
Figure 7:
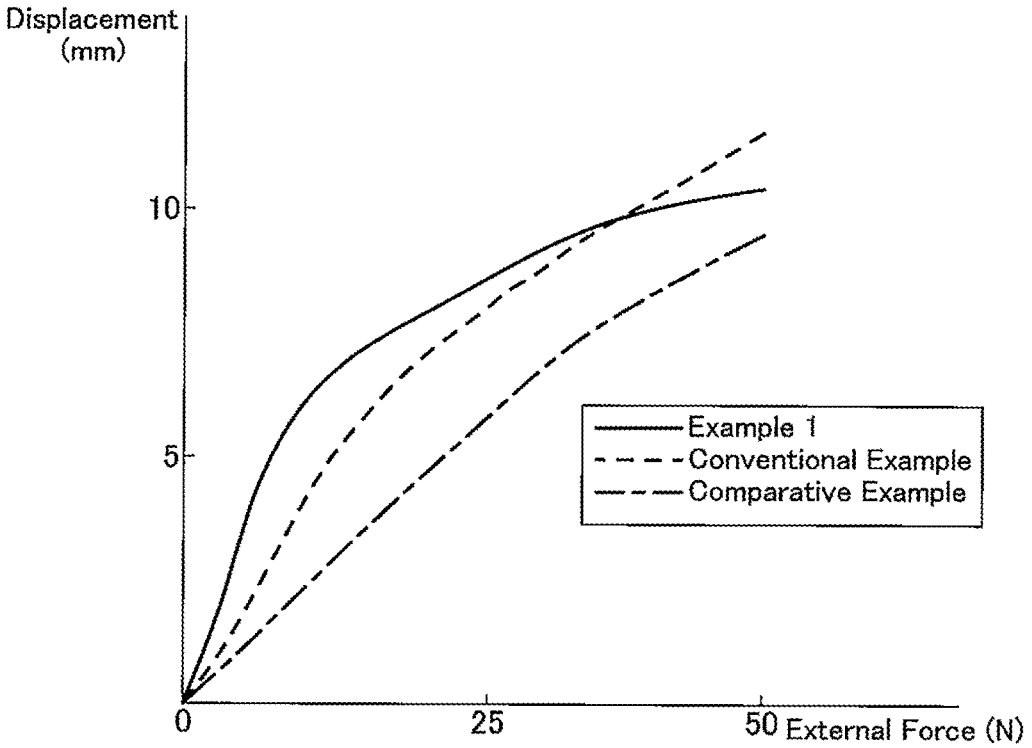
FIG. 7 is a graph illustrating a relationship between an external force applied to the damper and the displacement.

With regard to each of the dampers 1A, 100, 200, displacement with respect to an external force was measured with a displacement measurement means 300 as illustrated in FIG. 6. Specifically, one end of each of the dampers 1A, 100, 200 was connected to the displacement measurement means 300, and the other end was fixed. An external force in an upward and downward direction (in thickness direction) was applied to the displacement measurement means 300, and the magnitude of the displacement of the displacement measurement means 300 was measured. Specifically, the displacement of the displacement measurement means 300 as the displacement measurement means 300 was oscillated as with the voice coil bobbin was measured. The results are indicated in FIG. 7. The displacement indicated in FIG. 7 is an average value of the displacement due to upward application of an external force and the displacement due to downward application of an external force in FIG. 6.

Regarding the damper 100 of the conventional example and the damper 200 of the comparative example, the displacement is substantially proportional to the external force. The damper 100 of the conventional example has a large gradient so that the displacement can be ensured even when an external force is small. Meanwhile, the displacement becomes excessively large in a region where an external force is large. The damper 200 of the comparative example has a small gradient so that the displacement can be small in a region where an external force is large. Meanwhile, the displacement becomes excessively small in a region where an external force is small. In contrast, regarding the damper 1A of the present example, which employs a material which is more flexible than that of the conventional example, a curve indicating the damper 1A has a large gradient in a region where an external force is small, is bent near 15N, and has a small gradient in a region where an external force is greater than the above. The damper 1A (1B) according to the present example (and Example 2 to be described below) has a small displacement in an upward and downward direction when an external force is large. Therefore, a material which is more flexible than that of the conventional example can be used.

The damper 1A is capable of having a displacement greater than that of the dampers 100, 200 of the conventional example and the comparative example when an external force is small and having displacement smaller than that of the damper 100 of the conventional example when an external force is large. Accordingly, a speaker apparatus equipped with the damper 1A has superior efficiency than a speaker apparatus equipped with the dampers 100, 200 of the conventional example and the comparative example. Furthermore, the oscillatory system is less likely to be damaged as compared to that of the speaker apparatus equipped with the damper 100 of the conventional example.

Example 1 describes the damper 1A including the opening portion 2 having one opening, the corrugation portion 3, which is formed around the opening portion 2 and includes at least one convexoconcave arranged in the radial direction, the planar portion 4A, which is formed around the corrugation portion 3 and has the planar surface 40A, and the attachment portion 5, which is formed around the planar portion 4A, wherein the planar portion 4A only includes planar surfaces arranged at two heights: the first planar surface 41, which is extended substantially parallel to the attachment portion 5 at a height in the thickness direction different from that of the attachment portion 5 and the second planar surface 42, which is formed parallel to the first planar surface 41 and is arranged at a different height in the thickness direction. However, the planar portion may further include an additional planar surface at a height different from those of the first planar surface 41 and the second planar surface 42.

Example 2

Figure 8:
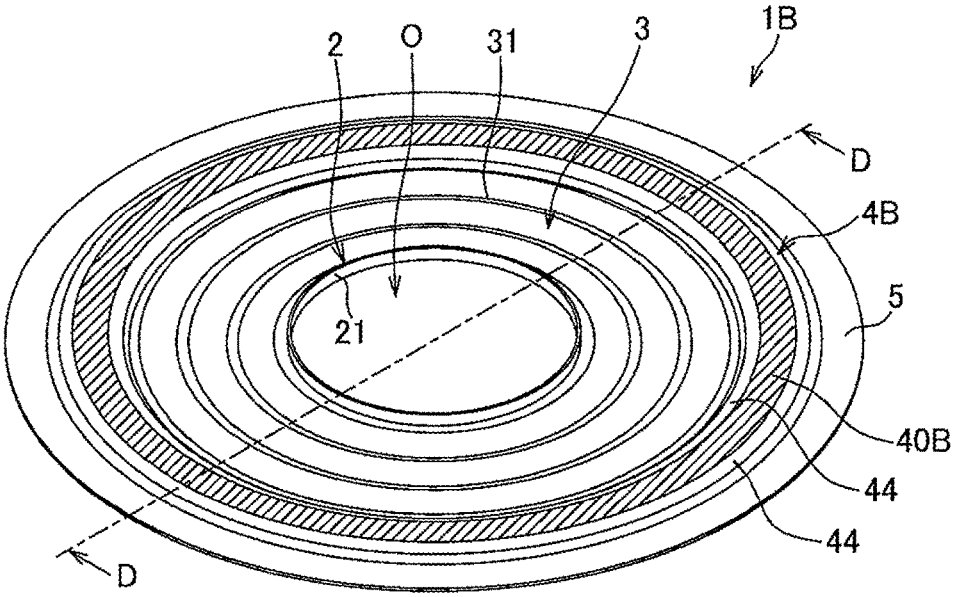
FIG. 8 is a perspective view illustrating the damper according to Example 2.

As illustrated in FIG. 8, the damper 1B according to Example 2 includes an opening portion 2 having an opening O, a corrugation portion 3 having an convexoconcave 31, a planar portion 4B having one planar surface 40B, and an attachment portion 5.

Figure 9:
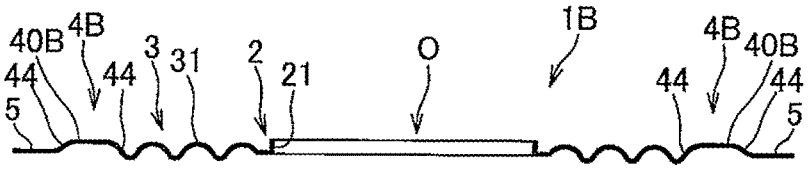
FIG. 9 is a cross-sectional view cut along line D-D of FIG. 8.

The planar portion 4B includes the planar surface 40B, which is generally formed in an annular shape, and rising portions 44, which are arranged across the planar surface 40B in the radial direction. As illustrated in cross-section in FIG. 9, the planar surface 40B is arranged on one side (upper side) in the thickness direction beyond the attachment portion 5.

As with Example 1, the aforementioned configuration suppresses damage to the oscillatory system due to an excessive input signal and enables an increase in efficiency of the speaker apparatus.

Furthermore, the planar portion 4B having one planar surface 40B can have a simple configuration as compared to the planar portion 4A having the plurality of planar surfaces 40 according to Example 1.

In addition, the present invention is not limited to Examples 1 and 2, but includes other configurations or the like that can achieve the object of the present invention. Variations or the like described below are included in the present invention.

For example, in Example 1 above, the plurality of planar surfaces 40 include the first planar surface 41, which is arranged on one side in the thickness direction beyond the attachment portion 5 and the second planar surface 42, which is arranged on the other side. However, the plurality of planar surfaces may include three or more types of planar surfaces arranged at different heights in the thickness direction. Furthermore, it is sufficient that the plurality of planar surfaces is extended substantially parallel to the attachment portion at a height in the thickness direction different from that of the attachment portion. For example, all the planar surfaces may be arranged either on one side or on the other side beyond the attachment portion.

Furthermore, in Example 1 above, 16 planar surfaces 40 (eight first planar surfaces 41 and eight second planar surfaces 42) have eight-fold rotational symmetry. However, when the plurality of planar surfaces have two- or more-fold rotational symmetry, the same effect as Example 1 above can be provided. Furthermore, for example, when the planar portion is sufficiently formed to hardly deform and partial deformation of the damper is suppressed, the plurality of planar surfaces may be formed asymmetrically.

In addition, the best configuration and method for carrying out the present invention are disclosed in the aforementioned description. However, the present invention is not limited thereto. In short, although the present invention is basically particularly illustrated and described with respect to particular embodiments, those skilled in the art can add a variety of variations with respect to the shape, the material, the quantity, and the other detailed configurations with regard to the aforementioned embodiments without departing from the technical idea and the scope of the object of the present invention. Accordingly, the descriptions that limit the shape, the material or the like disclosed above are exemplary descriptions for the sake of easy understanding of the present invention, but do not limit the present invention. Therefore, the descriptions of the names of members free of apart or the whole of the limitations regarding the shape, the material or the like are included in the present invention.

REFERENCE SIGNS LIST

1A, 1B damper
2 opening portion
3 corrugation portion
4A, 4B planar portion
5 attachment portion
31 convexoconcave
40A, 40B planar surface
41 first planar surface
42 second planar surface
43 connection
O opening

The invention claimed is:

1. A damper comprising:
an opening portion having one opening;
a corrugation portion formed around the opening portion, the corrugation portion including at least one convexoconcave portion arranged in a radial direction in relation to a central axis of the damper;
a planar portion formed around the corrugation portion, the planar portion having a plurality of planar surfaces extending adjacent one another along a circumferential direction in relation to the central axis; and
an attachment portion formed around the planar portion,
wherein the plurality of planar surfaces extend substantially parallel to the attachment portion at a height in a thickness direction different from that of the attachment portion, and include a first planar surface and a second planar surface arranged at a height in the thickness direction different from that of the first planar surface, the first and second planar surfaces alternately extending adjacent one another along the circumferential direction.

2. The damper according to claim 1, wherein the planar surfaces are arranged on one side in the thickness direction beyond the attachment portion.

3. The damper according to claim 1, wherein the opening is formed in a circular shape in plan view, and
the plurality of planar surfaces have rotational symmetry relative to an axis of symmetry, which is the central axis of the damper and that passes through a center of the opening and is parallel in the thickness direction.

4. The damper according to claim 1, wherein the first planar surface is arranged on one side beyond the attachment portion in the thickness direction, and
the second planar surface is arranged on the other side beyond the attachment portion in the thickness direction.

5. A speaker apparatus comprising:
the damper according to claim 1.

6. A damper comprising:
an opening portion having one opening;
a corrugation portion formed around the opening portion, the corrugation portion including at least one convexoconcave portion arranged in a radial direction;
a planar portion formed around the corrugation portion, the planar portion having a plurality of planar surfaces extending adjacent one another along a circumferential direction in relation to the central axis;
an attachment portion formed around the planar portion; and
a connection configured to connect the planar surfaces, which are adjacent to one another in the circumferential direction,
wherein the plurality of planar surfaces extends substantially parallel to the attachment portion at a height in a thickness direction different from that of the attachment portion.

7. The damper according to claim 6, wherein the planar surfaces are arranged on one side in the thickness direction beyond the attachment portion.

8. The damper according to claim 6, wherein the opening is formed in a circular shape in plan view, and
the plurality of planar surfaces have rotational symmetry relative to an axis of symmetry, which is the central axis of the damper and that passes through a center of the opening and is parallel in the thickness direction.

9. The damper according to claim 6, wherein a first planar surface is arranged on one side beyond the attachment portion in the thickness direction, and
a second planar surface is arranged on the other side beyond the attachment portion in the thickness direction.

10. A speaker apparatus comprising:
the damper according to claim 6.

* * * * *